US007051383B1

(12) United States Patent
Paz

(10) Patent No.: US 7,051,383 B1
(45) Date of Patent: May 30, 2006

(54) POWERED LIFT TOILET SEAT

(76) Inventor: Ohad Paz, 45 Pinchas Rozen Street, Tel Aviv 69512 (IL)

( * ) Notice: Subject to any disclaimer, the term of this patent is extended or adjusted under 35 U.S.C. 154(b) by 0 days.

(21) Appl. No.: 11/130,127

(22) Filed: May 17, 2005

(51) Int. Cl.
*A47K 13/10* (2006.01)

(52) U.S. Cl. ..... 4/667; 4/246.1; 4/246.5; 4/246.4; 4/409; 4/408

(58) Field of Classification Search ..... 4/246.1–246.5, 4/667, 254, 408, 411, 409

See application file for complete search history.

(56) References Cited

U.S. PATENT DOCUMENTS 3,458,872 A * 8/1969 Hellstrom et al. ..... 4/237
4,297,750 A * 11/1981 Lutz ..... 4/244.2
4,993,085 A * 2/1991 Gibbons ..... 4/667
5,063,617 A * 11/1991 Ward et al. ..... 4/667

* cited by examiner

*Primary Examiner*—Khoa D. Huynh
(74) *Attorney, Agent, or Firm*—Dekel Patent Ltd.; David Klein

(57) ABSTRACT

A powered lift toilet seat including a toilet seat for sitting on, a back support for supporting a back of a person sitting on the toilet seat, and an actuator connected to the toilet seat and the back support by a linkage device for raising and tilting the toilet seat and for moving the back support outwards.

4 Claims, 2 Drawing Sheets

POWERED LIFT TOILET SEAT

FIELD OF THE INVENTION

The present invention relates generally to a powered lift toilet seat used in association with a toilet bowl and which may be used to assist a person in being raised and lowered relative to the toilet bowl.

BACKGROUND OF THE INVENTION

Powered lift toilet seats are well known in the art. For example, U.S. Pat. No. 4,587,678 to Love, et al. describes a stationary frame with fixed handrails. A seat assembly is pivotally coupled to the stationary frame and a ball screw motor and lift arm are provided for pivotally moving the seat frame assembly relative to the stationary frame. While most toilet lift seats incorporate some form of pivoting seat assembly, U.S. Pat. No. 3,925,833 to Hunter describes a vertically movable toilet seat. Hunter employs a hydraulic cylinder for raising and lowering the seat as opposed to the electric motor of Love, et al.

Another version of an electrically operated toilet seat is described in U.S. Pat. No. 5,155,873 to Bridges, which has armrests that may be swung out of the way to enable an attendant to assist a disabled person in using the device. Another form of a hydraulically powered lift seat is described in U.S. Pat. No. 4,993,085 to Gibbons, which includes a pair of hydraulically operated lift assemblies with associated armrests which are tilted so as to cause the armrests to move in an upward and forward position as the mechanism is operated. The seat is provided with a second pair of hydraulically operated lifts in order to tilt the seat up and forward as the lift assemblies are operated.

U.S. Pat. No. 5,309,583 to White, et al. describes a powered toilet seat that has separate sets of mechanical linkages for raising and lowering a seat and for raising and lowering an armrest. While the seat is constrained to both lift and move forward slightly while it is being rotated forwardly, the armrests follow a circular arc in which the armrests initially move predominately in the upward direction and complete the motion by moving predominately in a forward direction. In addition, the armrests are maintained in a horizontal orientation at all time.

U.S. Pat. No. 6,470,513 describes a lift for placement over a conventional toilet. The lift includes a raising and lower mechanism which assists users in sitting and standing, a washing mechanism which is used to wash the lower extremities after toilet use, and a drying mechanism which is used to dry the lower extremities after use of the washing mechanism.

SUMMARY OF THE INVENTION

The present invention seeks to provide a novel powered lift toilet seat, as described in detail hereinbelow. Unlike the prior art, in the present invention, there is a back support that helps push and raise a person from the toilet.

There is thus provided in accordance with an embodiment of the invention a powered lift toilet seat including a toilet seat for sitting on, a back support for supporting a back of a person sitting on the toilet seat, and an actuator connected to the toilet seat and the back support by a linkage device for raising and tilting the toilet seat and for moving the back support outwards.

The system may include further features. For example, in accordance with non-limiting embodiments of the invention, the actuator may be housed together with a toilet tank placed behind the back support. The toilet tank may have a recess for receiving therein the back support. The recess may be concave and a rear portion of the back support that is received in the recess may be convex.

The actuator may be connected to the back support by the linkage device for raising and pushing the back support outwards. One or more articulating arm rests may be provided that are deployed by the actuator.

The linkage device may be retractable into the toilet tank. The back support may include a tongue extending from a lower portion thereof that is arranged to contact and lift a rear portion of the toilet seat.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 7:
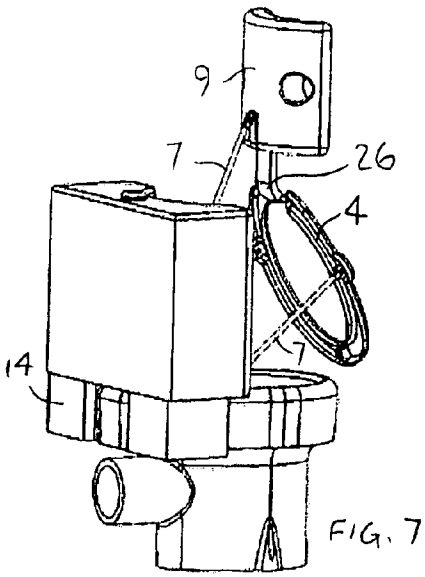
FIG. 7 is a simplified rear-view illustration of the powered lift toilet seat in the fully tilted position.
Figure 6:
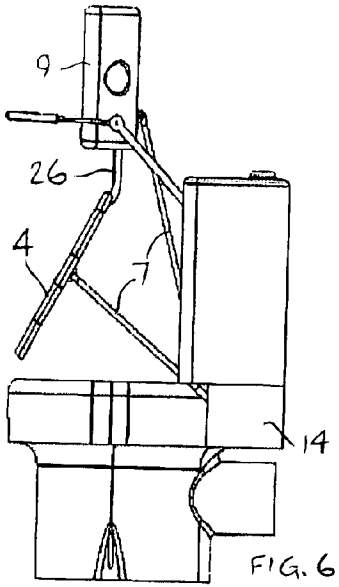
FIGS. 4, 5 and 6 are simplified side-view illustrations of the powered lift toilet seat, in respective horizontal, semi-tilted, and fully tilted positions.
Figure 5:
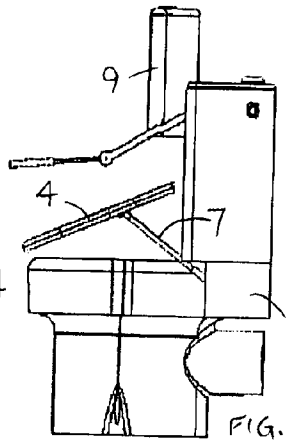
Figure 4:
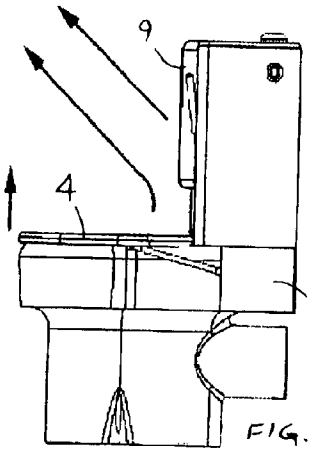
Figure 1:
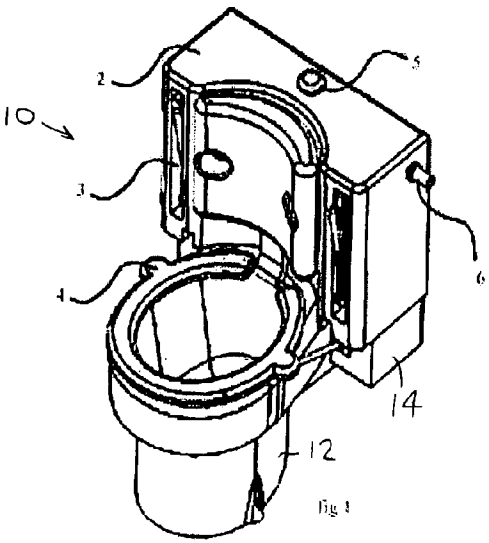
FIGS. 1, 2 and 3 are simplified pictorial illustrations of a powered lift toilet seat, constructed and operative in accordance with an embodiment of the present invention, in respective horizontal, semi-tilted, and fully tilted positions.
Figure 3:
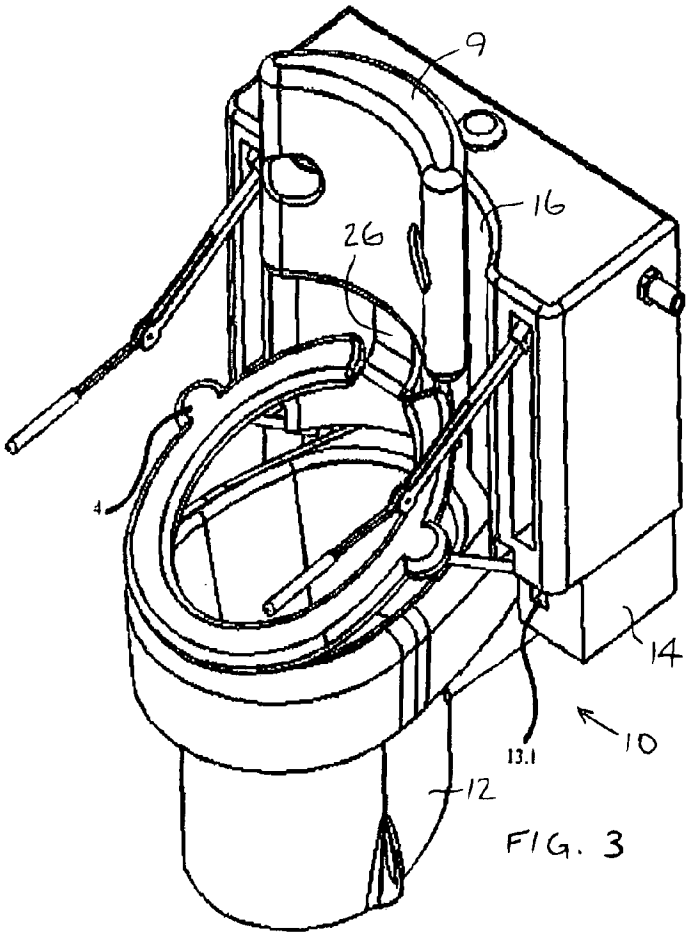
Figure 2:
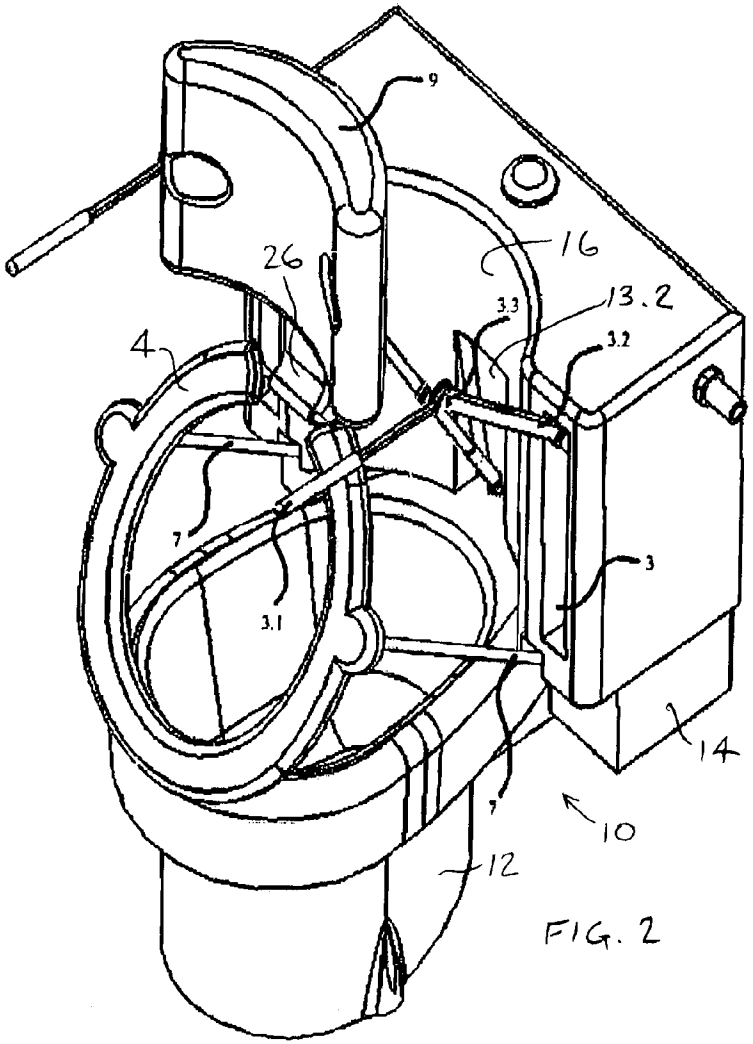

Reference is now made to FIGS. 1–7, which illustrate a powered lift toilet seat 10, constructed and operative in accordance with an embodiment of the present invention.

The powered lift toilet seat 10 may include a toilet seat 4 for sitting on and a back support 9 for supporting a back of a person (not shown) sitting on the toilet seat 4. As is well known in the art, toilet seat 4 is placed over a toilet bowl 12. A toilet tank 2 with flushing mechanism 5 is provided. A water connection 6 is provided for connecting to a water supply line (not shown).

An actuator 14 is connected to the toilet seat 4 and the back support 9 by a linkage device 7. Actuator 14 may be, without limitation, a gas spring, servomotor, linear actuator, solenoids, pistons, pneumatic, hydraulic or electromechanical manipulator, for example. Actuator 14 is capable of raising and tilting the toilet seat 4 and for moving the back support 9 outwards. The linkage device 7 may include any combination of linkage arms (e.g., straight, curved or jointed).

Actuator 14 may be housed together with toilet tank 2. The toilet tank 2 may have a recess 16 for receiving therein the back support 9. The recess 16 may be concave and a rear portion of the back support 9 that is received in the recess 16 may be convex.

As seen in FIGS. 4–7, actuator 14 may be connected to the back support 9 by the linkage device 7 for both raising and pushing the back support outwards.

One or more articulating arm rests may be provided that are deployed by the actuator 14. For example, in the illustrated embodiment, the arm rest has two articulating portions 3.1 and 3.2 that pivot at a joint 3.3. The arm rest may retract into a recess 3 in the toilet tank 2. The linkage device 7 may also be retractable into a recess 13.1 or 13.2 in the toilet tank 2.

Back support 9 may include a tongue 26 extending from a lower portion thereof that is arranged to contact and lift a rear portion of the toilet seat 4.

It will be appreciated by persons skilled in the art that the present invention is not limited by what has been particularly shown and described hereinabove. Rather the scope of the present invention includes both combinations and sub-combinations of the features described hereinabove as well as modifications and variations thereof which would occur to a person of skill in the art upon reading the foregoing description and which are not in the prior art.

What is claimed is:

1. A powered lift toilet seat comprising:

a toilet seat for sitting on;

a back support for supporting a back of a person sitting on the toilet seat; and an actuator connected to said toilet seat and said back support by a linkage device for raising and tilting said toilet seat and for moving said back support outwards, wherein said actuator is housed together with a toilet tank placed behind said back support, wherein said toilet tank has a recess for receiving therein said back support, and wherein said recess is concave and a rear portion of said back support that is received in said recess is convex.

2. The powered lift toilet seat according to claim 1 further comprising articulating arm rests that are deployed by said actuator.

3. The powered lift toilet seat according to claim 1 wherein said back support comprises a tongue extending from a lower portion thereof that is arranged to contact and lift a rear portion of said toilet seat.

4. The powered lift toilet seat according to claim 3 wherein said tongue is not hinged to said toilet seat.

* * * * *